United States Patent [19]

Dremann

[11] 4,398,674

[45] Aug. 16, 1983

[54] HYDRAULICALLY ACTUATED JAM RELEASE SYSTEM FOR A JAW TYPE CRUSHING APPARATUS

[76] Inventor: George H. Dremann, 1940 Hopkins St., Berkeley, Calif. 94707

[21] Appl. No.: 290,593

[22] Filed: Aug. 6, 1981

[51] Int. Cl.[3] ..... B02C 1/02

[52] U.S. Cl. ..... 241/30; 241/32; 241/264; 241/286

[58] Field of Search ..... 241/32, 37, 30, 264–269, 241/286, 290

[56] References Cited

U.S. PATENT DOCUMENTS 3,511,444 5/1970 Vitez ..... 241/32
3,918,648 11/1975 Anthony ..... 241/268 X
3,976,255 8/1976 Edwards ..... 241/264

FOREIGN PATENT DOCUMENTS 1276422 8/1968 Fed. Rep. of Germany .

*Primary Examiner*—Mark Rosenbaum

*Attorney, Agent, or Firm*—Bruce & McCoy

[57] ABSTRACT

A hydraulically actuated jam release system for a jaw type rock crusher wherein a massive, mechanically rigid retracting plate is disposed behind the crusher's stationary jaw to engage the entire width of the jaw to hold the stationary jaw in its operative position. Mechanical locking pins are hydraulically actuated by vertical hydraulic cylinders to mechanically lock the retracting plate in its forward position, and separate horizontal hydraulic retracting cylinders are provided to retract the retracting plate when the mechanical locking pins are disengaged therefrom, and to return the retracting plate to its forward position after the non-crushable material has been released from the crushing chamber of the crusher. The entire hydraulic system for the jam release is hydraulically operated through a series of suitable hydraulic valves preferably located at a central control station. It is an important aspect of the disclosure that once the retracting plate is mechanically locked by the locking pins, the stationary jaw does not require hydraulic pressure.

19 Claims, 11 Drawing Figures

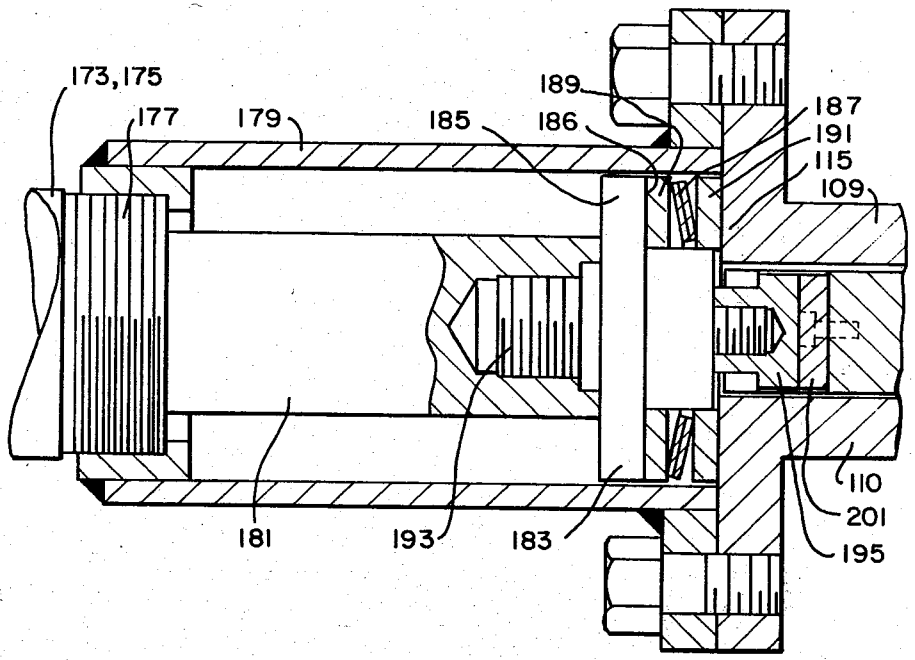
FIG.—8
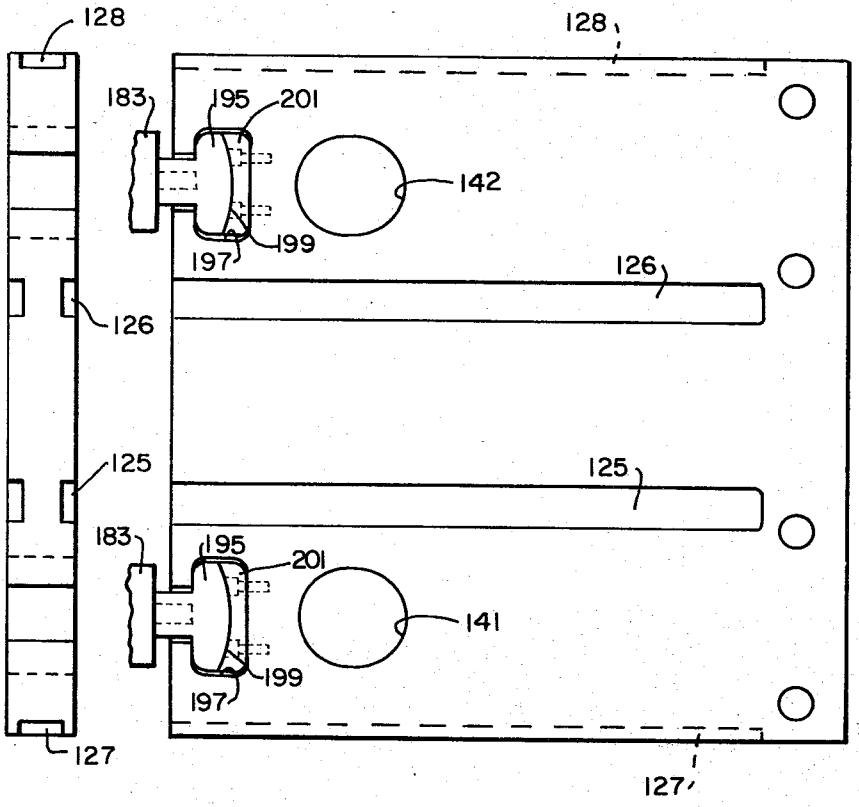
FIG.—7
FIG.—6

HYDRAULICALLY ACTUATED JAM RELEASE SYSTEM FOR A JAW TYPE CRUSHING APPARATUS

BACKGROUND OF THE INVENTION

The present invention relates to rock crushing machinery generally, and more particularly to jaw type rock crushing machinery wherein crushing forces are developed between two jaws, one a stationary jaw and the other a movable swing jaw.

Large rock crushing machinery is typically used in remote areas where operating problems must be handled on site. It is therefore a desirable object to design and construct a rock crushing machine which can be maintained and serviced by field operators in the minimum amount of time with a minimum amount of effort and skill. It is also important that any maintenance procedures that are required be carried out with minimal risk to the operator's safety.

One of the major problems encountered during rock crushing operations is the introduction into the crusher of non-crushable material, such as tramp iron. Such a non-crushable material causes the crusher to stall and can introduce serious structural problems. To avoid structural problems the flywheel of the crusher is designed to release when a non-crushable material enters the crushing chamber, thereby disabling the crusher until the material is removed. In a conventional jaw type rock crusher, removal of the non-crushable requires extensive downtime and expenditure of many labor hours, a process which lowers productivity, increases costs and affects operator safety.

The present invention provides a hydraulic jam release system which greatly simplifies the removal of non-crushables from a rock crusher and which substantially reduces the downtime involved in the removal operation. By means of the present invention, the massive steel stationary jaw of the rock crusher, which typically encounters crushing forces in excess of 200,000 pounds, depending on applied housepower, crusher r.p.m. and swing jaw displacement, can be retracted hydraulically and then hydraulically returned to its operative position. The invention provides easy-to-use hydraulic controls whereby a field operator can easily and efficiently unjam a crusher apparatus and return it quickly to service. Moreover, the jam release system of the invention provides for total mechanical isolation of the release system's hydraulics from the stationary jaw thereby allowing the hydraulic system to remain depressurized during the normal operation of the jaw crusher.

SUMMARY OF THE INVENTION

The present invention is a hydraulic jam release system for the stationary jaw of a jaw type crushing apparatus having a frame, a crushing chamber defined by the stationary jaw and an opposing swing jaw, and means for reciprocating the swing jaw. The hydraulically actuated jam release system includes a mechanically rigid horizontal retracting means slidably disposed in the crusher frame behind the lower end of the stationary jaw so that the forward end of the retracting means engages the lower end of the stationary jaw. Means are provided for holding the stationary jaw back against the forward end of the retracting means such that the position of the lower end of the stationary jaw is governed by the horizontal position of the retracting means.

At least one locking pin assembly is provided having a locking pin vertically disposed over the horizontal retracting means. The locking pin is positioned to be in alignment with a locking pin opening in the retracting means when the retracting means is positioned in its substantially full forward position. A first hydraulic means is provided for controllably raising and lowering the vertically disposed locking pin to, respectively, disengage and engage the locking pin opening in the retracting means. A second hydraulic reciprocating means is provided for controllably moving the retracting means horizontally in a rearward and forward direction of travel, for, respectively, opening and closing the stationary jaw. Separate valve means actuate the first and second reciprocating means to permit sequencing the movement of the vertically disposed locking pin and horizontal retracting means to open and close the stationary jaw.

The invention also includes a method for opening and closing a stationary jaw of a jaw type rock crushing apparatus by hydraulic means. The method is essentially comprised of the steps of placing the stationary jaw in a normally mechanically locked operative position and mechanically biasing the jaw in a rearward direction whereby mechanical locking parts are held firmly together. To open the jaw, the jaw is hydraulically moved slightly forward to a maximum forward position to release the mechanical locking parts from tight locking contact. The mechanical locking of the jaw is then disengaged such that the jaw is placed under hydraulic control. The jaw is then hydraulically retracted whereby a non-crushable material in the crusher can be released.

To close the stationary jaw, the jaw is first hydraulically returned to its maximum forward position. The mechanical locking is engaged and the hydraulic pressure removed whereby the mechanical biasing urges the jaw rearwardly to its normally mechanically locked operative position.

DESCRIPTION OF THE DRAWINGS

FIG. 6 is a rear elevational view of the horizontal retracting plate of the present invention.

FIG. 7 is a top plan view of the retracting plate shown in FIG. 6.

FIG. 8 is a partial cut-away view of the coupler which joins the retracting plate to the hydraulic ram of the horizontal cylinders.

DESCRIPTION OF THE PREFERRED EMBODIMENT

Figure 1:
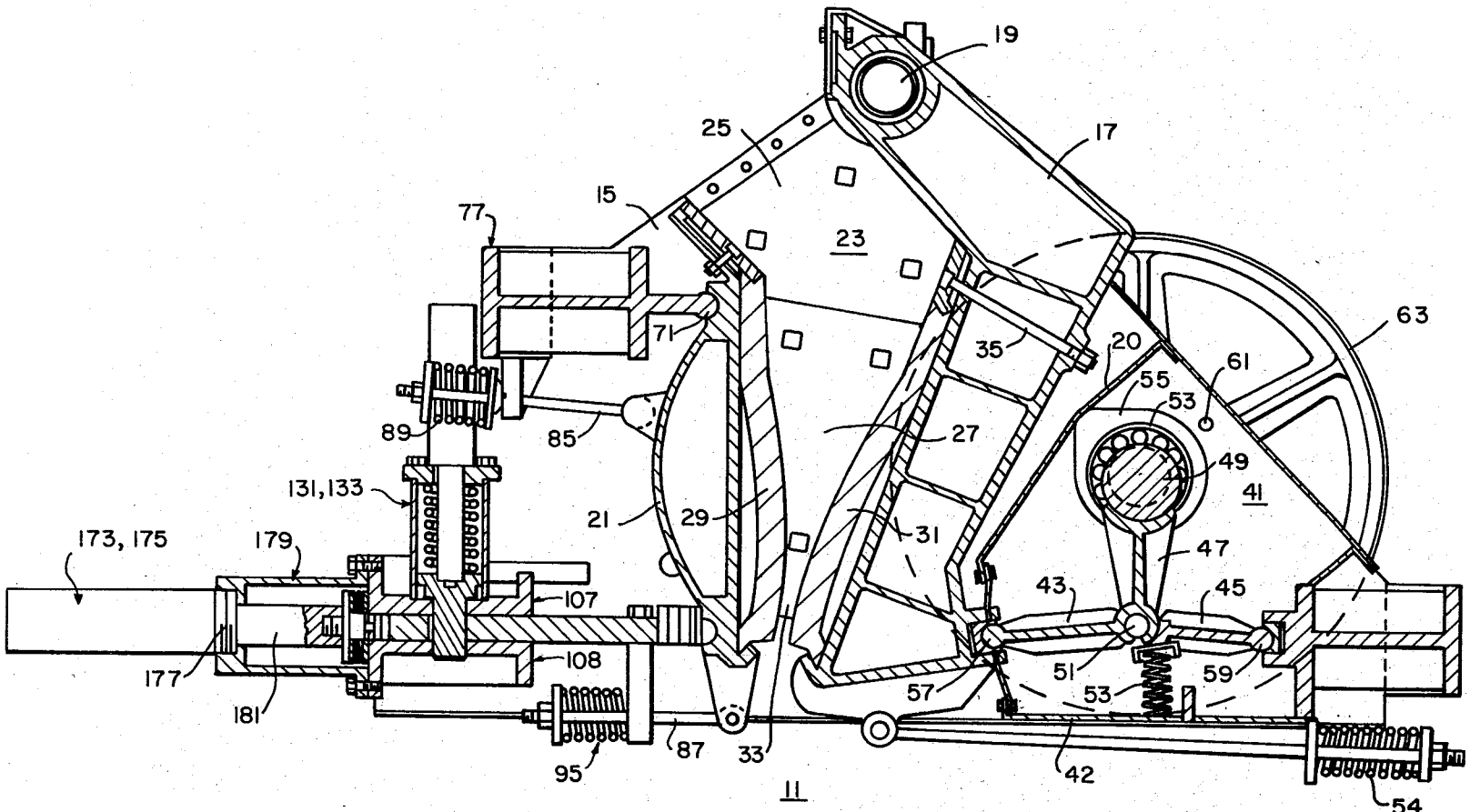
FIG. 1 is a cut-away, side elevational view of a jaw type rock crushing apparatus showing the hydraulic jam release system of the present invention.
Figure 2:
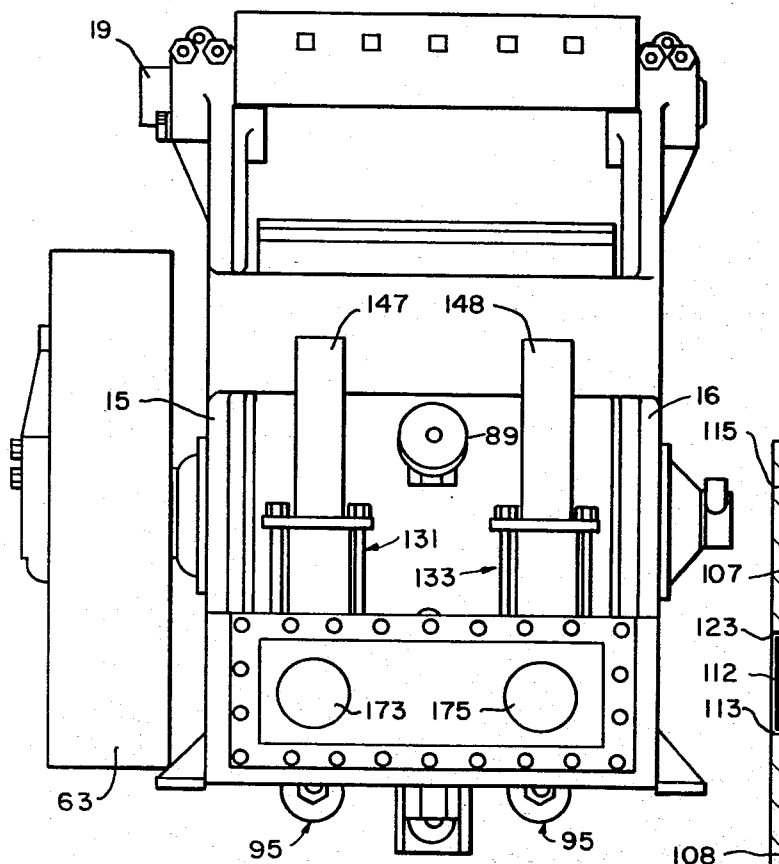
FIG. 2 is an end elevational view of the rock crushing apparatus shown in FIG. 1.
Figure 3:
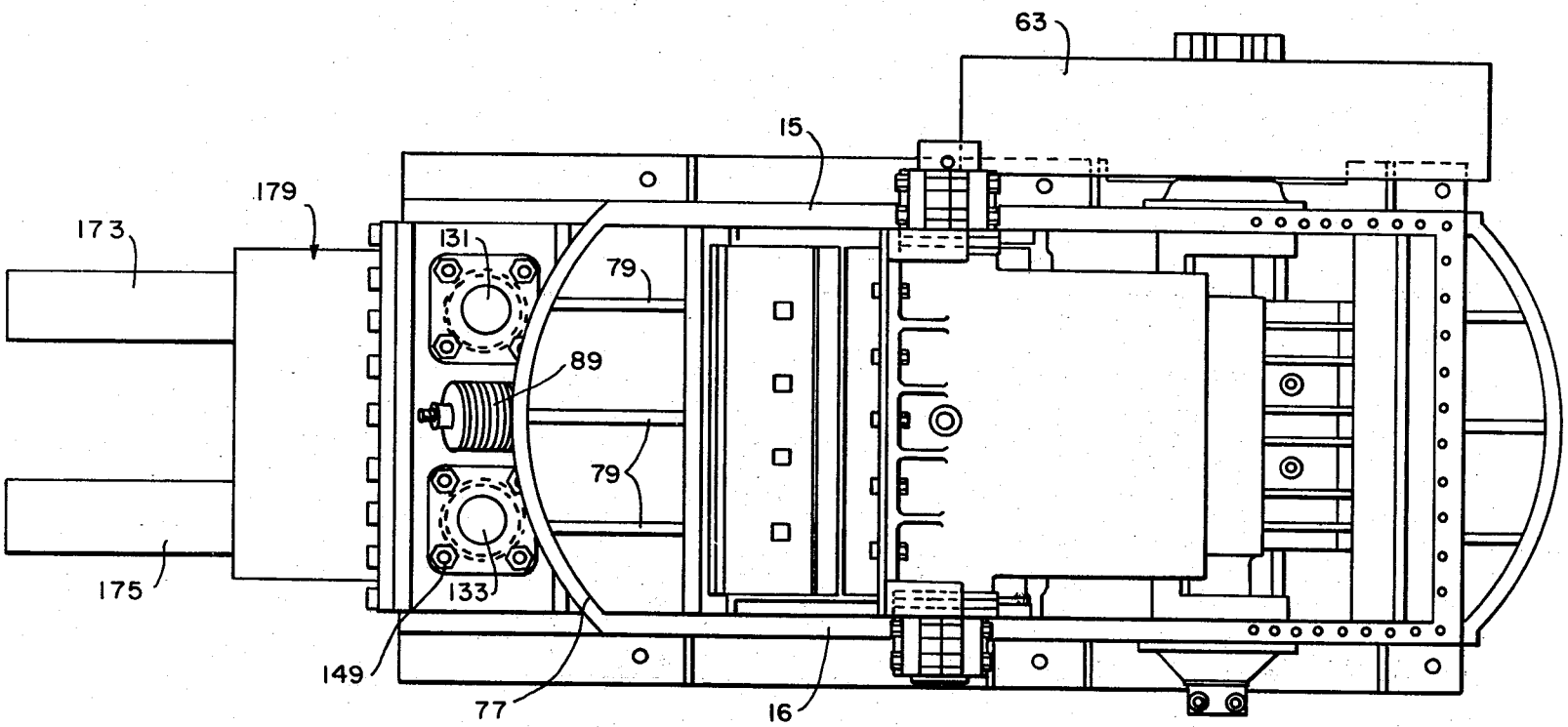
FIG. 3 is a top plan view of the jaw crushing apparatus shown in FIG. 1.

Turning now to the drawings, FIGS. 1-3 generally illustrate a jaw type crushing apparatus designed to crush hard abrasive rock by means of crushing forces created between two opposing jaws, one of which is stationary and the other which is movable. The crushing apparatus, which is generally denoted by the numeral 11, has a rigid support frame 13 having side plates 15, 16; the frame supports a swing jaw 17 by means of a hinge pin 19, and a stationary jaw 21 which opposes the swing jaw to form a crushing chamber 23. As is best illustrated in FIG. 1, abrasive rock placed in the mouth 25 of the crushing chamber 23 will be gravity fed to a crushing zone 27 situated between the opposed jaw plates 29, 31 of the stationary and swing jaw. The swing jaw 17, which is reciprocated as hereinafter described, delivers a straight line crushing force to the rock material in the crushing zone 27; as the rock is crushed, it falls by gravity through the chamber outlet 33 formed by the lower ends of the jaw plates. It should be noted that the jaw plates wear and therefore are replaceable. The plates are held to the jaw structure by means of spring loaded tension bolts, such as the tension bolt 35 illustrated in FIG. 1. Preferably fabricated of a manganese steel, the jaw plates can be designed to suit different crushing conditions and can be fabricated in one piece or two to more interlocking sections.

Means for reciprocating the swing jaw include a toggle mechanism, generally denoted 41, which drives the swing jaw through the reciprocating motion of toggle plates 43, 45. The toggle plates are reciprocated by pitman 47 which is held against the lower side of a rotating eccentric shaft 49 by means of lifter spring 53 and a swing jaw pull back spring 54. The lower end of pitman 47 is shown as bearing on the self-indexing toggle pin 51 directly below the eccentric shaft 49, such that no bending moment is produced on the lower end of the pitman. The lifter springs and pull back springs hold all of the toggle parts firmly together.

The toggle mechanism 41 is enclosed within a housing 42 generally formed by frame side plates 15, 16, a bottom plate 18 and a removable cover plate 20 which permits quick and easy access to the mechanism. The relatively massive, rigid eccentric shaft 49 is carried in heavy duty self-aligning roller bearings 53, secured in line-bored housings in the frame side plates. For lubrication of the bearings 49, the eccentric shaft 49, and the toggle pin 51, and also for lubrication of the toggle seats 57, 59, an oil bath system is provided wherein oil is introduced through inlet 61 into an oil bath formed at the bottom of the toggle housing 42.

The eccentric shaft 49 and toggle plates 43, 45, are driven to fly wheel 63 which can be belted directly to a drive motor and sheave (not shown). The fly wheel would normally be provided with a mechanical safety release (not shown) of a known design, such that with a pre-set amount of over-pressure the fly wheel "kicks out" to a free wheeling condition, removing the drive power from the eccentric shaft 49, and thereby shutting down the crushing action of the apparatus. The overpressure which would cause the fly wheel to "kick out" would be caused by a non-crushable material being introduced to the crushing zone 27 of the crushing chamber 23. Conventionally, the non-crushable would be removed from the crushing chamber by completely shutting down the apparatus, and physically removing the non-crushable material.

Figure 4:
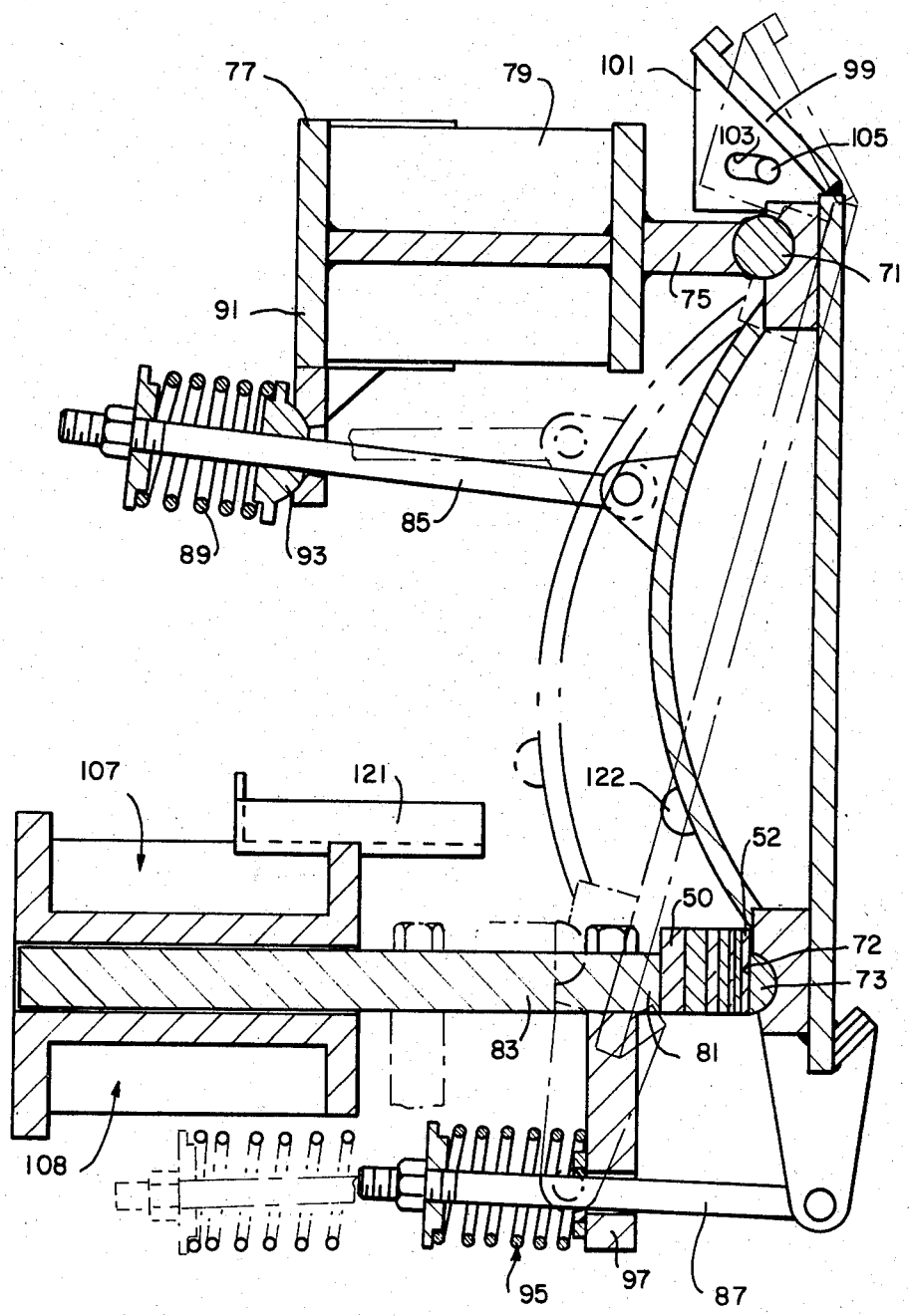
FIG. 4 is a cross-sectional view, in side elevation, of the jam release system of the present invention, showing the movement of the stationary jaw when the jam release is actuated.

Before describing the jam release system of the present invention, it is noted that the stationary jaw 21 laterally extends between the frame side plates 15, 16, without being physically attached to the side plates. As best shown in FIG. 4, the stationary jaw is held against an upper seat 71 and lower seat 73, both of which engage the jaw over its entire width. The upper stationary jaw seat 71 is attached to an extension plate 75, which in turn is attached to a laterally extending upper strongback member 77 forming part of the crusher frame 13. As seen in FIG. 3, the upper strong back is well reinforced with cross-ribs 79 and designed to provide a massive and structurally rigid, non-movable support to the upper end of the jaw. Upper and lower spring loaded hold back rods 85, 87 generally serve as a hold back means for the stationary jaw for holding the jaw against the upper and lower stationary jaw seats, 71, 73. As shown in FIG. 4, the spring 89 of the upper hold back rod 85, is a compression spring which reacts against the back side 91 of the upper strongback through a spherical grommet 93; likewise the spring 95 of the lower held back rod 87 acts in compression against a lower hold back bracket 97, which is secured to and extends downwardly from the forward end of the retracting plate 83.

The mechanically rigid and relatively massive steel retracting plate 83, which is preferably heat treated to a Brinell hardness of 275 (just below the lower limit of the free machining range) serves as the retracting means for the stationary jaw. It is seen from FIG. 4 that due to the coacting hold back forces of the upper and lower hold back rods 85, 87, the lower end of the stationary jaw will follow the retracting plate as the retracting plate is horizontally retracted in a rearward direction, with the stationary jaw being hinged about the upper stationary jaw seat 71. An upper extension 99 of the stationary jaw has depending jaw retainer plates 101 at each end of the jaw. Slots 103 in the retainer plates engage guide pins 105 secured to the side plates 15, 16 of the apparatus frame 13. The retainer plates prevent the jaw from physically falling off the upper jaw seat 71 in the event the upper hold back rod spring 89 falls off or is backed off too far.

Figure 5:
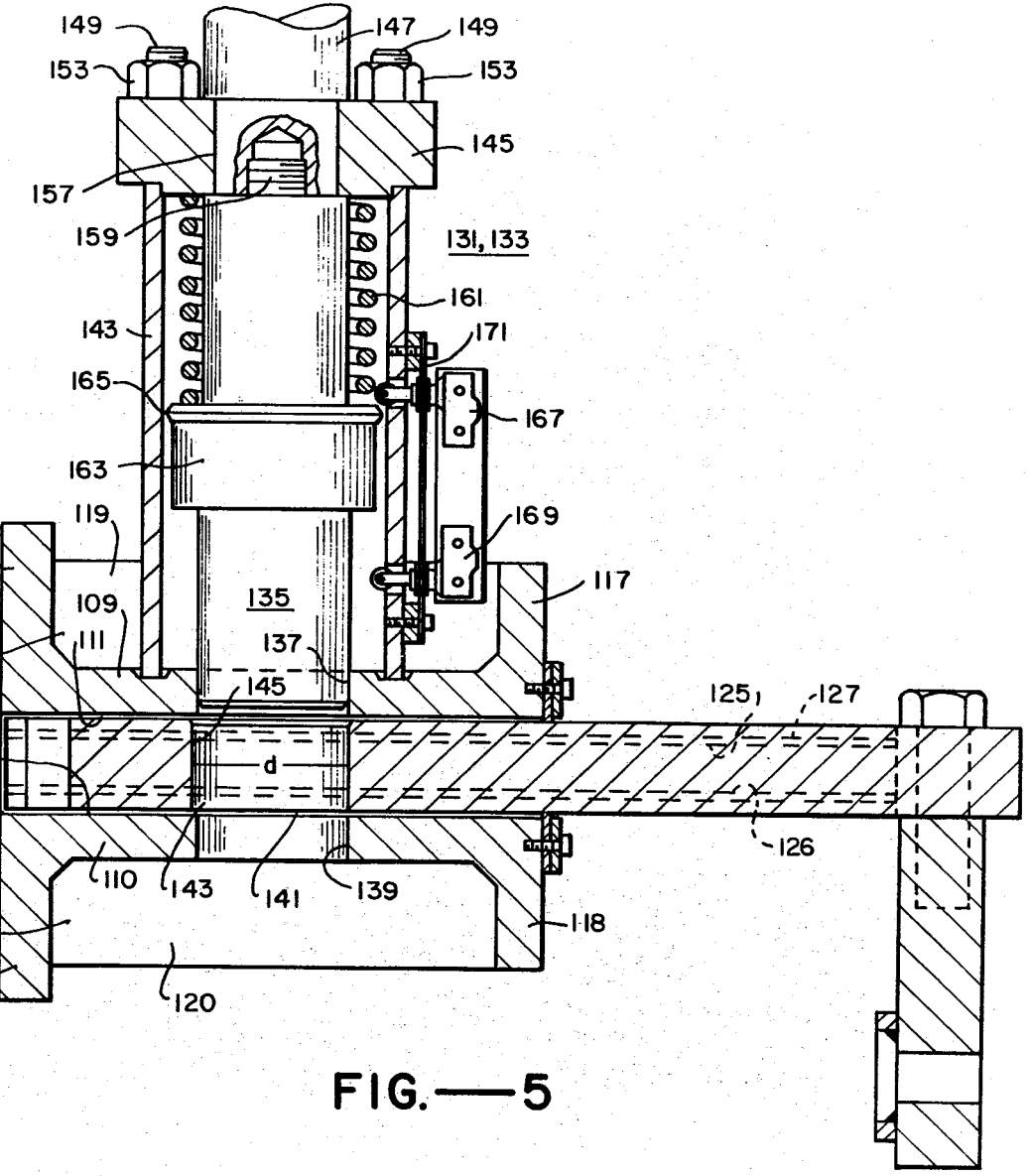
FIG. 5 is a cross-sectional view of the horizontal retracting plate of the preferred embodiment of the invention, of the strongback members for holding the plate, and of the locking pin assembly for mechanically interlocking the plate.

As shown in FIGS. 4 and 5, the retracting plate 83, which holds the position of the lower end of the stationary jaw 21, is slidably held between two lower retracting plate strongback members 107, 108, which, like the upper strong back 77, laterally extends the entire width of the crusher frame 13. Each of the lower strongback members 107, 108 has a horizontal guide wall 109, 110 having opposing horizontal guide wall surfaces 111, 112, which form the top and bottom guide surfaces of the guide slot 113 through which the retracting plate 83 is constrained to travel. The two retracting plate strongbacks are reinforced by vertically and transversely extending rear walls 115, 116, front walls 117, 118 and center walls 119, 120. As hereinafter described, the vertical rear walls 115, 116 provide a mounting surface for the horizontal hydraulic cylinders used to move the retracting plate. A jack cradle 121 is also preferably secured to the top retracting plate strongback member 107. The purpose of the jack cradle is to provide a stationary support for a removable hydraulic jack, which can be used to force the stationary jaw forward in order to exchange the spacer bars 50 at the forward end of the retracting plate 83. A projecting knob 122 is provided on the back of the stationary jaw for engaging the hydraulic ram of the jack placed in the jack cradle.

The guide slot 113 for the retracting plate 83 is further bounded by vertical side walls (shown by line 123 in FIG. 5) which extend between the opposing horizontal guide surfaces 111, 112 of the strongback horizontal guide walls 109, 110. The vertical guide walls 123 are spaced apart to accommodate the full width of the retracting plate, and typically will be positioned substantially at the extreme lateral ends of the two strongback members 107, 108. Thus, it can be seen that the retracting plate, as it passes through the opposing strongback members, is completely captured on four sides. To keep the retracting plate perfectly aligned within the guide slot 113, the plate is preferably provided with longitudinal keyslots 125, 126, 127, 128, on its top and bottom surfaces and on its side surfaces as shown in FIG. 7. Mating lubricated guide keys (not shown) are provided on the horizontal guide surfaces 111, 112 and in the vertical wall surfaces which form the guide slot 113.

Two locking pin assemblies 131, 133 are laterally spaced apart over the top retracting plate strongback member 107 to provide the locking mechanism for the retracting plate. The construction of each of the locking pin assemblies is best illustrated in FIG. 5. Each assembly generally comprises a locking pin 135 actuated by a first hydraulic means comprised of hydraulic lifting cylinders 147, 148. The locking pin is positioned in alignment with locking pin guide holes 137, 139 in the horizontal guide walls 109, 110 of the opposing retracting plate strongback members, and also aligns with the corresponding locking pin openings 141, 142 in the retracting plate 82 when the retracting plate is in its substantially full forward position, which is the desired position of the retracting plate when the stationary jaw of the crusher is to be in its unretracted operative position. It is noted that the operative position of the stationary jaw is adjustable, not by the position of the retracting plate, but by inserting or deleting spacer bars 50 between the retracting plate and the lower stationary jaw seat 73.

Preferably, the locking pin of the locking pin assembly will be cylindrically shaped with the locking pin openings in the retracting plate having a slightly elongated, oval shape such that it will have a long dimension, d, in the direction of travel of the plate. The elongated openings allow the retracting plate to be moved or advanced a small distance in order to provide a small clearance between the locking pins and plate openings which permits easy extraction and insertion of the pins.

The locking pin assembly is further shown as having a locking pin housing 143 capped by a top wall 145 on which the vertical hydraulic lifting cylinder 147 is mounted, and through which the locking pin assembly tie down rods, such as the four illustrated tie down rods 149, are secured, such as by means of nuts 153. The end of the hydraulic ram 157 which projects through the housing top wall 145 is suitably joined to the top of the locking pin 135, such as by means of a threaded coupling 159 which allows for easy assembly and disassembly. A restoring spring 161, which serves as a spring means for biasing the locking pin downwardly in its locking position, reacts against top wall 145 and a locking pin collar 163 located intermediate the two ends of the locking pin 135. It is noted that the laterally projecting collar also provides a projecting cam surface 165, which serves to trigger the two electrical limit switches 167, 169 mounted to the side of the locking pin housing 143 by bracket 171; the limit switches operate to indicate the excursion limits of the locking pin as hereinafter described.

While the jam release system described herein is described as having two locking pin assemblies and hence two locking pins, it is understood that the invention is not confined to the described number, size or shape of the locking pins. Generally speaking, the size and number of locking pins will be dictated by the expected forces on the retracting plate and the contact surface bearing area of the pins that will be required to safely withstand these forces.

The invention's second hydraulic means controllably moves the retracting plate horizontally in a forward and rearward direction. This second hydraulic means includes two horizontal hydraulic retracting cylinders 173, 175, generally illustrated in FIGS. 1–3. The retracting cylinders are secured by a threaded end 177 to the back of a back housing 179 attached to the rear vertical walls 115, 116 of the retracting plate strongbacks 107, 108. The back housing is generally of a width and depth which is sufficient to receive the retracting plate 83 in its full retracted position (shown in dash lines in FIG. 4). The end of the hydraulic ram 181 of each hydraulic cylinder is joined to the rearward end of the retracting plate through a spring coupler 183. The coupler's belville springs 187 serve as a means for biasing the retracting plate in a rearward direction against the locking pins 135 when the locking pins are inserted into the retracting plate 83. The belville springs are provided to keep the retracting plate and locking pins in intimate mechanical contact with one another so as to prevent excessive wear from differential movement between these two parts which can be caused by crushing and rebound forces.

In the coupler 183 a radially extending collar 185 provides a supporting shoulder surface 186 for the belville spring 187, which is sandwiched between two heat treated plates 189, 191. It is seen that the belville spring reacts against the vertical rear walls 115, 116 of the retracting plate strongbacks 107, 108 whereby the hydraulic ram 181 and retracting plate 83 are biased away from the strongbacks in a rearward direction. It is further seen that a threaded extension 193 secures the spring coupler to the hydraulic ram 181, while coupling to the retracting plate is achieved by means of a self-aligning T-connector 195 inserted into a T-slot 197 formed in the rear end of the retracting plate. The projecting end 199 of the T-connector is curved in the plane of the retracting plate and seats against a correspondingly curved shoe 201 secured to the back of the T-slot 197. The T-slot is shown as having a lateral dimension which is slightly larger than the lateral dimension of the T-connector so that there will be a certain amount of clearance within the slot to permit self-alignment of the hydraulic ram. Thus, if one hydraulic ram moves slightly forward or behind the other hydraulic ram, any twisting or lateral movement of the hydraulic rams with respect to the retracting plate will be taken up by a compensating movement of the T-connector.

It is noted that both the lifting and retracting hydraulic cylinders 131, 133, 173, 175 used in this invention can be selected from commercially available parts. For example, hydraulic cylinders manufactured by Enerpac having suitable retracting and forward forces can be used. Suitable forces would include lifting cylinders having a retracting force of 5 tons and a 30 ton forward force, and retracting cylinders with retracting and forward forces, of, respectively, 17 and 75 tons.

Figure 9:
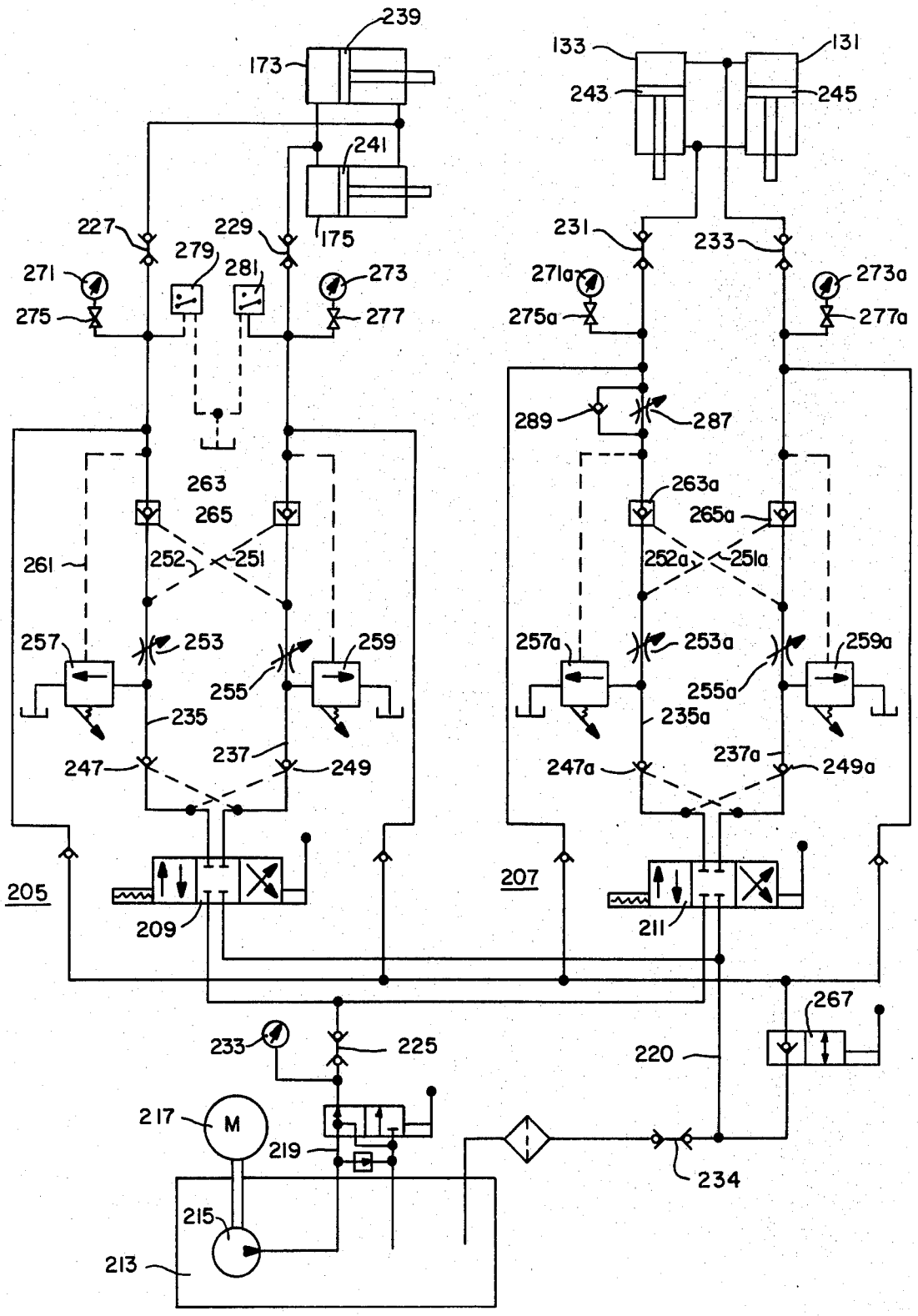
FIG. 9 is a schematic diagram of the hydraulic control circuits for the horizontal and vertical hydraulic cylinders of the invention.
Figure 10:
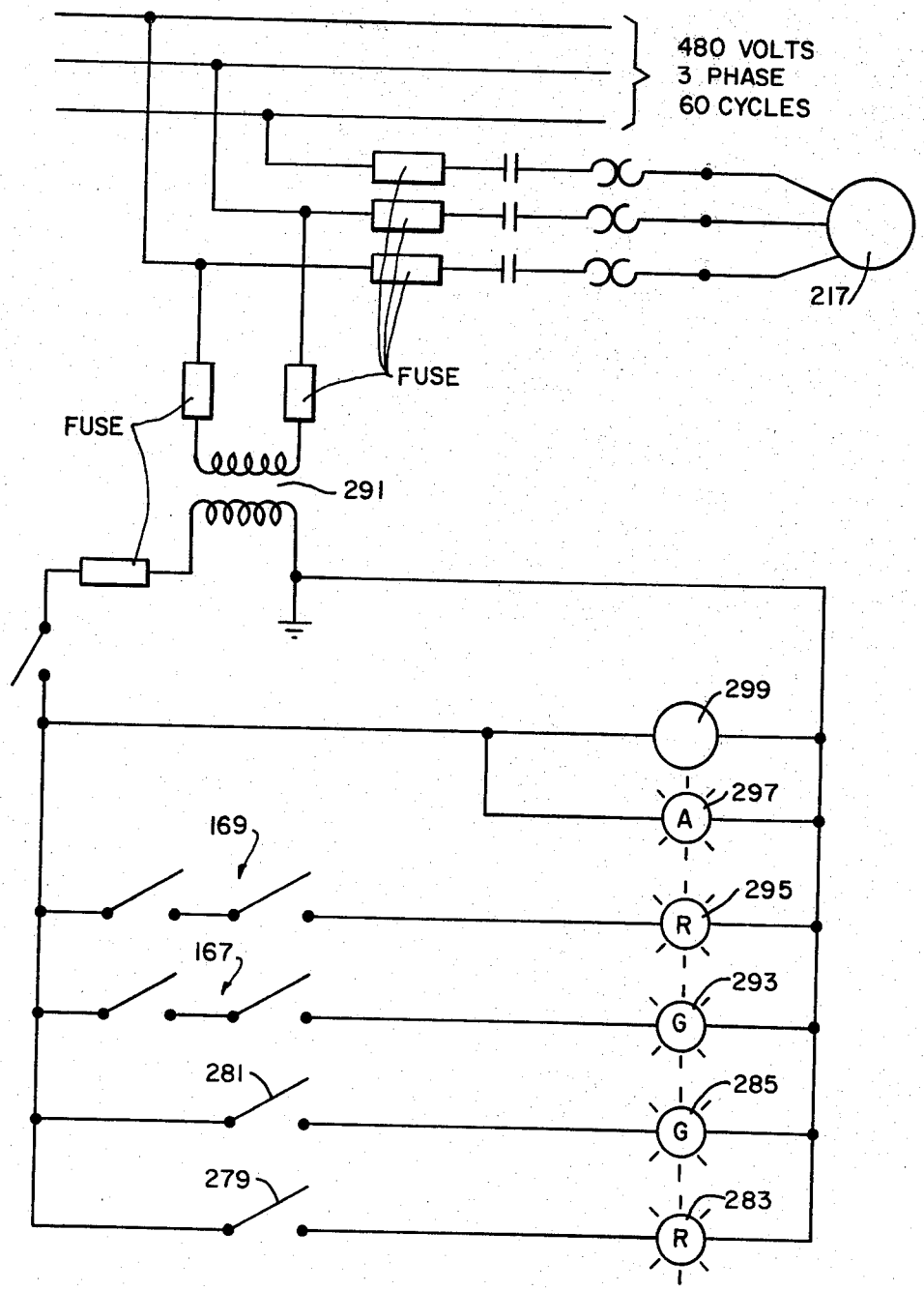
FIG. 10 is a circuit diagram of the electrical power supply for the hydraulic control system shown in FIG. 9.
Figure 11:
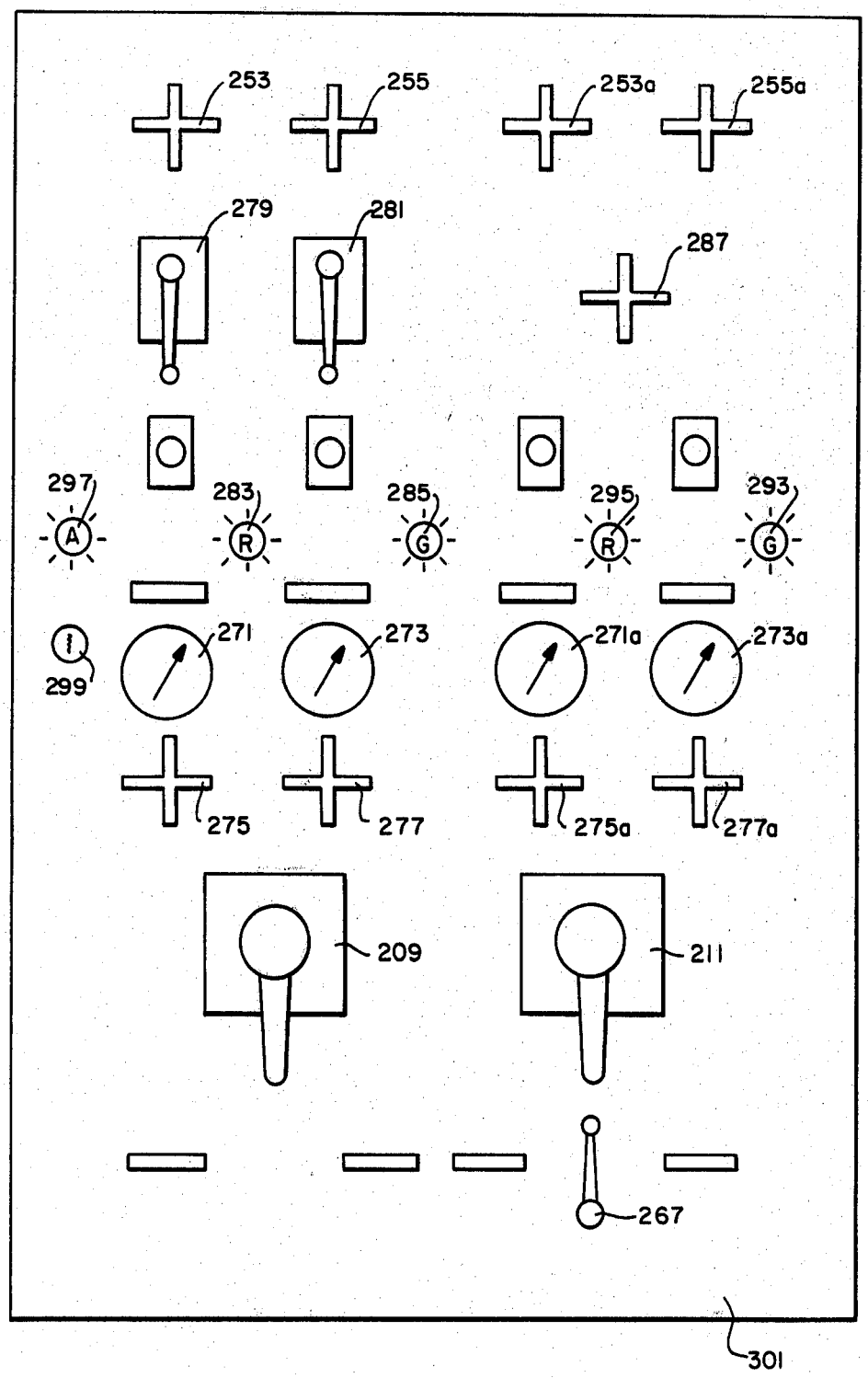
FIG. 11 is a pictorial representation of the control panel for operating the jam release system of the invention.

The hydraulic control system for operating the horizontal retracting cylinders 173, 175 and the vertical lifting cylinders 147, 148 is schematically illustrated in FIG. 9, with the hydraulic control system's basic electrical supply circuit and the central control station panel being illustrated in FIGS. 10 and 11. Referring to FIG. 9, the horizontal retracting cylinders 173, 175 and vertical lifting cylinders 147, 148 are shown as being hydraulically actuated by parallel hydraulic circuits, generally denoted 205 and 207, each of which is manually operated by a separate three position manual control valve 209 and 211, which, as shown, includes cross coupled pilot operated check valves 247, 247*a* and 249, 249*a*. The hydraulic circuits are supplied from a reservoir 213 suitably located near the jaw crushing apparatus, with hydraulic pressure being delivered by a pump 215 and pump motor 217 through a main supply line 219 having a main control valve 221 and pressure indicator 223. The hydraulic lines can conveniently be connected between the jaw release system's control station (the panel of which is illustrated in FIG. 11) and the jaw crushing apparatus by means of quick-disconnect couplings 225, 227, 229, 231, 233, 234.

As shown, both the horizontal and vertical cylinder hydraulic circuits 205, 207 are substantially identical, except for the differences noted below. Each circuit has a front hydraulic line 235, 235(*a*) and back hydraulic line 237, 237(*a*) for selectively supplying hydraulic pressure to the front or back side of the cylinder heads 239, 241, 243, 245 of the hydraulic cylinders; when one line is pressurized the other line, by means of the cross coupled pilot operated check valve, is allowed to dump to reservoir. The three position manual control valves 209, 211 can be switched to reverse the connection of the front and back cylinder supply lines 235, 235*a* and 237, 237*a* between the pressurized main supply line 219 and the main drain line 220; the "center" position of the manual control valves act to isolate the two hydraulic lines of each circuit from the main supply and drain lines, thereby providing a static fluid system whereby the hydraulic cylinders are held in a stationary position by means of the pilot operated check valves.

It can be seen that the direction and flow of fluid through the front and back hydraulic lines 235, 235(*a*), 237, 237(*a*) are controlled by adjustable orifices 253, 255, 253(*a*), 255(*a*) and cross-connected pilot controlled check valves 263, 263(*a*), 265, 265(*a*). It is seen that the pilot lines of the check valves, such as the pilot lines 251, 252, cross-connect to opposite hydraulic lines within the circuit whereby, when one line is pressurized by the manual control valve, the pilot line connected to that line opens the check valve in the opposite unpressurized line to permit a return flow of fluid to the main drain line 220. Adjustable dump valves 257, 257(*a*) and 259, 259(*a*) are actuated by pilot pressure, such as by pilot line 261 in the case of dump valve 257, and provide pressure regulation in the hydraulic system. (Pressure regulating valves can also be used). As an overall safety feature, an additional manually controlled decompression or dump valve 267 is provided, which hydraulically communicates with both the hydraulic circuits 205, 207. By throwing the manual control dump valve 267 an operator can totally decompress the hydraulic system, if for example, the operator detects a person working around the jaw crusher while the massive stationary jaw is being hydraulically moved.

To measure pressure at the hydraulic cylinders, line pressure gauges 271, 271(*a*) and 273, 273(*a*) are connected to the cylinder hydraulic lines through snubber valves 275, 275(*a*) and 277, 277(*a*). Included in the hydraulic circuit 205 for the horizontal cylinders 239, 241 are additional adjustable pressure switches 279, 281 actuated from the front and back hydraulic lines 235, 237. These switches provide a means for actuating suitable visual indicators, such as the dump light 283 and compression light 285 shown in FIGS. 10 and 11. By properly adjusting the adjustable switches 279 and 281 and dump valves 257 and 259, the panel lights 283, 285 can be used to tell the operator when the retracting plate is fully retracted or fully returned to a full forward position.

With respect to the hydraulic control circuit 207 for the vertical hydraulic lift cylinders, this circuit provides an additional adjustable orifice 287, bypassed in the forward or pin engagement direction by a check valve 289. By means of this additional unidirectional adjustable orifice the rate of return of the vertical cylinder heads 243, 245, and hence the return rate of the locking pins 135 to their locking positions, can be adjusted. This prevents the bearing spring 161 from overpowering the hydraulic system and causing cavitation at the ram end of the cylinder.

Referring to FIG. 8, the pump motor 217 is typically a three phase, reconnectable 240/480 volt motor. FIG. 8 shows the motor connected to a 480 volt three phase power line with two power legs of three phase line to the motor being tapped through a suitable grounded single phase control circuit transformer 291 for providing power to the indicating lights 283, 285, 293, 295, 297. The indicating lights 293, 295, which are preferably chosen to be green (for locked) and red (for unlocked) indicating lights, provide the indication to the operator of the position of the locking pin 135 as detected by the electrical limit switches 167, 169. Finally, it is desirable for safety reasons to provide a key switch 299 for the pump motor. An amber indicator light 297 is provided to indicate the "on" or "off" position of the key switch.

OPERATION

In describing the operation of the hydraulic jam release system of the present invention, reference is made to the control panel, generally designated 301, illustrated in FIG. 11.

In normal operation the jaw crushing apparatus 11 is a totally mechanical system, with the mechanical retracting plate, which holds the stationary jaw in position, being mechanically held in its forward operating position by the mechanical locking pins 135. Thus, it can be seen that, without taking the steps required to remove the mechanical locking pins from the retracting plate, the stationary jaw of the crushing apparatus would not be held under hydraulic pressure, and accordingly hydraulic pressure is not required during crushing. It is a significant feature of the invention that before operating the hydraulic jam release the mechanical locking pins of the system must first be disengaged hydraulically to put the retracting plate under hydraulic control.

An operator will only actuate the hydraulic jam release system of the invention when a non-crushable material is deposited in the crushing chamber, causing the safety release of the fly wheel to kick out. (The presence of a non-crushable might also be indicated by the sounding of a suitable alarm). When this event occurs, the operator will first switch off the drive motor to the jaw crusher, and then proceed to actuate the hydraulic jam release of the invention.

First, it is noted that the hydraulic jam release system is preadjusted by adjusting the pressure limit switches 279, 281 of the horizontal cylinder hydraulic circuit 205. These switches can be set by setting them just below the pressure required to trip the pressure regulating dump valves 257, 257(*a*) and 259, 259(*a*). The pressure regulation of the dump valves are adjusted by adjusting orifices 253, 255, 253(*a*), 255(*a*), such that adequate hydraulic pressure is developed in the lines to move the retracting plate as required. Additional preadjustment includes adjusting the gauge snubber valves 275, 277, 275(*a*), 277(*a*) to prevent damage to the line gauges.

Thusly preadjusted, the operator who activates the jam release system first turns on the electrical pump motor by means of the key switch 299. At this point the safety dump valve 267 and manual control valves 209, 211 should all be closed. After opening the main supply line valve 221, the operator will turn the left most manual control valve (209) to the right (indicating the direction of travel of the retracting plate) in order to cause the retracting plate to move slightly forward against the belville spring 187. To move this small distance the pressure delivered by the retracting plate hydraulic cylinders must be sufficient to slightly compress the non-crushable material in the crushing chamber. A belville spring which permits a forward movement of approximately 1/16 inch would be generally sufficient, however, if additional movement is required, additional belville springs can be added. Generally the actual forward movement will be only about 1/32 inch. Thus, it is seen that the normally mechanically locked operative position of the stationary jaw will be slightly behind the maximum forward position which the jaw must obtain to unlock the system and place the jaw and retracting plate under hydraulic control.

With the retracting plate urged or extended slightly forward, the manual control valve 209 for the horizontal cylinders is returned to its center position where it maintains a static pressurized condition in the hydraulic circuit to hold the horizontal cylinders in place. The second and right-most manual control valve 211 is then turned in a clockwise direction to pressurize the back side of the vertical hydraulic cylinders for lifting the locking pins. Under hydraulic pressure the locking pins are lifted from the retracting plate, and as soon as the locking pins are fully retracted, as indicated by green indicating panel light 297, the second manual control valve is returned to its center position to hold the locking pins in their unlocked position.

With the locking pins removed and with the retracting plate under hydraulic control, the operator will turn the manual control valve 209 for the horizontal cylinders to the left (again indicating the direction of travel of the horizontal retracting plate) and the retracting plate will be retracted to open the stationary jaw. The position of the stationary jaw with the retracting plate in its retracted position is generally shown in FIG. 4 by phantom lines, and it is seen in FIG. 4 that the swing motion of the jaw causes the lower end of the jaw to change its vertical position relative to the fixed vertical position of the retracting plate. Specifically, it can be seen that the lower seat 73 of the stationary jaw moves upwardly relative to the spacer bars 50 which are constrained to travel in a horizontal direction by their containment slots (not shown) in the side plates of the crushing apparatus. To accommodate this change in the alignment of parts, the base 72 of the half-round seat is allowed to rotate and to slide against the outermost space bar 52. A rotatable seat can be provided by simply securing the seat to the lower end of the jaw by suitable slotted retaining brackets (not shown).

In its retracted position, the non-crushable material will usually clear itself from the crushing chamber. After this occurs the stationary jaw will be returned to its operating position by simply reversing the above operating steps, namely, actuating the horizontal and vertical hydraulic cylinders to restore the horizontal plate and locking pins to their original mechanically locked position. The left green and red panel lights 285 and 283 will indicate to the operator when the retracting plate is fully retracted (red) and when it is restored to normal operating position (green); likewise the right green and red panel lights 297 and 295 will indicate when the locking pins are fully raised (red) or fully lower (green).

Therefore, it can be seen that the present invention provides a hydraulic jam release system for a jaw crushing apparatus which is easily operated and which completely isolates the hydraulic features of the system from the mechanical features of the jaw crushing apparatus. This isolation is achieved by mechanically locking and unlocking the system as required, by means of a structure that can withstand the severe structural forces developed in a jaw crusher.

Although the present invention as been described in considerable detail in the above specification, it is not intended that the application be limited to such detail, except as necessitated by the appended claims.

What I claim is:

1. In a jaw type crushing apparatus having a stationary frame, a crushing chamber defined by a stationary jaw and an opposing swing jaw downwardly hinged from hinge points in said frame, and means for reciprocating said swing jaw, a hydraulically actuated jam release system comprising mechanically rigid, substantially horizontal retracting means having a forward end and a rearward end and at least one locking pin opening intermediate said forward and rearward ends, said retracting means being slidably disposed in said frame behind the lower end of said stationary jaw to that the forward end of said retracting means engages the lower end of said stationary jaw, hold back means for holding said stationary jaw against the forward end of said retracting means whereby the stationary position of said stationary jaw is governed by the horizontal position of said retracting means, at least one locking pin assembly having a locking pin substantially vertically disposed over said horizontal retracting means, said locking pin being in alignment with the locking pin opening in said retracting means when said retracting means is positioned in its substantially full forward position, first hydraulic means for controllably raising and lowering said vertical locking pin to, respectively, disengage and engage the locking pin opening in said retracting means, second hydraulic reciprocating means for controllably moving said retracting means horizontally in a forward and rearward direction of travel, and valve means for actuating said first and second hydraulic reciprocating means to permit sequencing the movement of said horizontal retracting means and said vertically disposed locking pin to open and close said stationary jaw.

2. The hydraulically actuated jam release system of claim 1 wherein said locking pin opening is slightly elongated in the direction of travel of said retracting means to provide a relatively small rebound space within said locking pin opening for alignment.

3. The hydraulically actuated jam release system of claim 1 wherein said horizontal retracting means is a retracting plate transversely extending substantially the width of said stationary jaw.

4. The hydraulically actuated jam release system of claim 3 wherein the frame of said crushing apparatus includes opposed strongback members extending transversely of said frame behind said stationary jaw so as to form a guide slot for said retracting plate.

5. The hydraulically actuated release system of claim 4 wherein said locking pin assembly is positioned over said strongback members and wherein said strongback members have vertically aligned guide holes for guiding said locking pin through the locking pin opening in said retracting plate.

6. The hydraulically actuated jam release system of claim 5 wherein said locking pin assembly includes a locking pin housing which extends upwardly from said upper strongback members, wherein said housing substantially surrounds said locking pin means and supports said first hydraulic reciprocating means for raising and lowering the locking pin means.

7. The hydraulically actuated jam release system of claim 1 or 6 wherein said locking pin assembly includes restoring spring for biasing said locking pin downwardly into its locking position.

8. The hydraulically actuated jam release system of claim 3 wherein there are at least two laterally spaced locking pin assemblies positioned over said retracting plate with corresponding locking pin openings in said retracting plate.

9. The hydraulically actuated jam release system of claim 3 wherein said second hydraulic reciprocating means includes at least two laterally spaced and horizontally disposed hydraulic retracting cylinders secured to said frame behind said retracting plate, each of said hydraulic cylinders having a hydraulic ram having its free end secured to the rearward end of said retracting plate.

10. The hydraulically actuated jam release system of claim 9 wherein the end of the hydraulic ram of said hydraulic cylinders is joined to the rearward end of said retracting plate by means of a spring coupler disposed and adapted to react against said stationary frame when said retracting plate is in a substantially full forward position whereby, when said retracting plate is in a substantially full forward position, said plate will be biased in a rearward direction against said locking pin when said locking pin is engaged in said locking pin opening.

11. The hydraulically actuated jaw release system of claim 10 wherein said spring coupler includes at least one belville spring.

12. In a jaw type crushing apparatus having a stationary frame, a crushing chamber defined by a stationary jaw and an opposing swing jaw downwardly hinged from hinge points in said frame, and means for reciprocating said swing jaw, a hydraulically actuated jam release system comprising two opposed top and bottom strongback members having vertical rear walls and extending transversely of said frame behind said stationary jaw and forming a guide slot therebetween, said strongback members forming a portion of said stationary frame and having at least two pairs of laterally spaced, vertically aligned guide holes therein, a mechanically rigid, substantially horizontal retracting plate having a forward end and a rearward end and at least two laterally spaced locking pin openings intermediate said forward and rearward ends, said retracting plate being slidably disposed between the guide slot formed by said opposed strongback members behind the lower end of said stationary jam so that the forward end of said retracting plate engages the lower end of said stationary jaw, hold back means for holding said stationary jaw against the forward end of said retracting means whereby the stationary position of said stationary jaw is governed by the horizontal position of said retracting plate, at least two laterally spaced locking pin assemblies disposed over the top strongback member of said opposed strongback members, each of said assemblies having a locking pin substantially vertically disposed over and in alignment with one of the pair of guide holes in said strongback members, each of said guide hold pairs in said strongback members being positioned so as to be in alignment with one of the locking pin openings in said retracting plate when said retracting plate is positioned in its substantially full forward position, said locking pin openings in said retracting plate being slightly elongated in the direction of travel of said retracting plate, a hydraulic lifting cylinder vertically secured to the top of each of said locking pin assemblies for controllably raising and lowering said vertical locking pins of said locking pin assemblies to, respectively, disengage and engage the locking pin openings in said retracting plate, at least two laterally spaced and horizontally disposed hydraulic retracting cylinders secured to the rearwalls of said opposed strongback members behind said retracting plate for controllably moving said retracting plate horizontally in a forward and rearward direction of travel, a spring coupler for joining the end of the hydraulic rams of each of said hydraulic retracting cylinders to the rearward end of said retracting plate, said spring coupler being disposed and adapted to react against the rear walls of said opposed strong back member when the retracting plate is in a substantially full forward position whereby, when said retracting plate is in a substantially full forward position, said plate will be biased in a rearward direction against said locking pins when said locking pins are engaged in said locking pin openings of said retracting plate, and valve means for actuating said lifting and retracting cylinders to permit sequencing the movement of said horizontal retracting plate and vertical locking pins to open and close said stationary jaw.

13. The hydraulically actuated jam release system of claim 12 wherein longitudinal guide keys and corresponding keyslots are provided on said retracting plate and said retracting plate guide slot.

14. The hydraulically actuated jam release system of claim 12 wherein said retracting plate is fabricated of steel heat treated to a Brinell hardness of approximately 275.

15. The hydraulically actuated jam release system of claim 12 wherein said spring coupler for joining the hydraulic retracting cylinder rams to the rearward end of said retracting plate includes a self-aligning T-connector for said retracting plate, and wherein T-slots are formed in the rearward end of said retracting plate for receiving the T-connector of said spring coupler.

16. The hydraulically actuated jam release system of claim 15 wherein the projecting end of said T-connectors are curved in the plane of the retracting plate and said T-slots for receiving said T-connectors have a correspondingly curved shoe secured to the back thereof.

17. The hydraulically actuated jam release system of claim 1 or 12 including means or biasing said retracting means in a rearward direction against said locking pin when said locking pin is engaged in said locking pin opening.

18. A method for opening and closing the stationary jaw of a jaw type rock crushing apparatus by hydraulic means comprising the steps of placing said stationary jaw in a normally mechanically locked operative position and mechanically biasing said stationary jaw in a rearward direction whereby mechanical locking parts are held in firm contacting relation, to open the stationary jaw, hydraulically moving said jaw slightly forward to a maximum forward position to release said mechanical locking parts from their tight contacting relation, disengaging the mechanical locking parts of the stationary jaw whereby said jaw is placed under hydraulic control, hydraulically retracting the stationary jaw, and to close the stationary jaw, hydraulically returning the jaw to its maximum forward position, engaging mechanical locking parts of said jaw, and removing hydraulic pressure to return said jaw to its normally mechanically locked operative position.

19. The method of claim 18 wherein said mechanical locking parts of said stationary jaw are engaged and disengaged hydraulically.

* * * * *

UNITED STATES PATENT AND TRADEMARK OFFICE

CERTIFICATE OF CORRECTION

PATENT NO. : 4,398,674

DATED : 08/16/83

INVENTOR(S) : George H. Dremann

It is certified that error appears in the above—identified patent and that said Letters Patent is hereby corrected as shown below:

In the title page, the "Assignee"

should read - - Process Technology Corporation,

Oakland, California

Signed and Sealed this

*Seventh* Day of *February 1984*

[SEAL]

*Attest:*

GERALD J. MOSSINGHOFF

*Attesting Officer*

*Commissioner of Patents and Trademarks*